US009352440B2

(12) United States Patent
David

(10) Patent No.: US 9,352,440 B2
(45) Date of Patent: May 31, 2016

(54) SERIAL FEATURE TRACKING FOR ENDPOINT DETECTION

(71) Applicant: Applied Materials, Inc., Santa Clara, CA (US)

(72) Inventor: Jeffrey Drue David, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 184 days.

(21) Appl. No.: 14/265,707

(22) Filed: Apr. 30, 2014

(65) Prior Publication Data

US 2015/0314415 A1 Nov. 5, 2015

(51) Int. Cl.
*B24B 49/12* (2006.01)
*B24B 37/013* (2012.01)

(52) U.S. Cl.
CPC ..... *B24B 37/013* (2013.01); *B24B 49/12* (2013.01)

(58) Field of Classification Search
CPC ..... B24B 49/12; B24B 37/04; B24B 37/013; B24B 49/10
USPC ..... 451/5, 6, 41, 287–290
See application file for complete search history.

(56) References Cited

U.S. PATENT DOCUMENTS

| | | | | |
|---|---|---|---|---|
| 5,838,447 | A | 11/1998 | Hiyama et al. | |
| 6,111,634 | A | 8/2000 | Pecen et al. | |
| 6,153,116 | A | 11/2000 | Yang et al. | |
| 6,296,548 | B1 | 10/2001 | Wiswesser et al. | |
| 6,399,501 | B2 | 6/2002 | Birang et al. | |
| 8,814,631 | B2 * | 8/2014 | David | B24B 37/013 451/41 |
| 8,944,884 | B2 * | 2/2015 | David | B24B 37/013 451/11 |
| 8,977,379 | B2 * | 3/2015 | David | B24B 37/013 700/121 |
| 2007/0042675 | A1 * | 2/2007 | Benvegnu | B24B 37/013 451/5 |
| 2008/0099443 | A1 | 5/2008 | Benvegnu et al. | |
| 2010/0124870 | A1 | 5/2010 | Benvegnu et al. | |
| 2011/0275281 | A1 | 11/2011 | David et al. | |
| 2011/0318992 | A1 | 12/2011 | David et al. | |

FOREIGN PATENT DOCUMENTS

| | | |
|---|---|---|
| JP | 2004-001227 | 1/2004 |
| KR | 10-0510919 | 11/2005 |

OTHER PUBLICATIONS

International Search Report and Written Opinion in International Application No. PCT/US2015/025616, dated Jun. 30, 2015, 7 pages.

* cited by examiner

*Primary Examiner* — Robert Rose
(74) *Attorney, Agent, or Firm* — Fish & Richardson P.C.

(57) ABSTRACT

A method of controlling polishing includes polishing a substrate having a second layer overlying a first layer, detecting exposure of the first layer with an in-situ monitoring system, receiving an identification of a selected spectral feature and a characteristic of the selected spectral feature to monitor during polishing, measuring a sequence of spectra of light from the substrate while the substrate is being polished, determining a first value for the characteristic of the feature at the time that the first in-situ monitoring technique detects exposure of the first layer, adding an offset to the first value to generate a second value, and monitoring the characteristic of the feature and halting polishing when the characteristic of the feature is determined to reach the second value.

20 Claims, 6 Drawing Sheets

SERIAL FEATURE TRACKING FOR ENDPOINT DETECTION

TECHNICAL FIELD

The present disclosure relates to optical monitoring during chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint cannot be determined merely as a function of polishing time.

In some systems, a substrate is optically monitored in-situ during polishing, e.g., through a window in the polishing pad. However, existing optical monitoring techniques may not satisfy increasing demands of semiconductor device manufacturers.

SUMMARY

Some optical endpoint detection techniques track a characteristic of a selected spectral feature, e.g., the wavelength of a peak in the spectrum, as polishing progresses. However, for some layer structures on a substrate, a selected feature may move too much, e.g., the wavelength position of a peak can move completely across the wavelength band being monitored by the spectrograph before polishing is completed. A technique to address this issue is to serially "stitch" together tracking of multiple features. For example, once the wavelength of an initially tracked peak crosses a boundary, a new peak is selected and the wavelength of the new peak is tracked.

In one aspect, a method of controlling polishing includes polishing a substrate, measuring with an in-situ spectrographic optical monitoring system a first sequence of spectra of light reflected from the substrate while the substrate is being polished, and selecting a first spectral feature in the first sequence of spectra. The first spectral feature has an evolving first location through the first sequence of spectra. For each measured spectrum from the first sequence of spectra, a first position value is determined for the first spectral feature to generate a sequence of first position values. That the location of the first spectral feature crosses a first boundary is determined based on the sequence of first position values. A second sequence of spectra of light reflected from the substrate is measured while the substrate is being polished after the first spectral feature has crossed the first boundary. Upon determining that the location of the first spectral feature has crossed the first boundary, a second spectral feature is selected. The second spectral feature has an evolving second location through the second sequence of spectra. For each measured spectrum from the second sequence of spectra, a second position value is determined for the second spectral feature to generate a sequence of second position values. A polishing endpoint is triggered or a polishing parameter is adjusted based on the second sequence of position values.

Implementations may optionally include one or more of the following advantages. Spectral feature tracking can be applied for polishing control of a wider variety of layer structures and compositions. Endpoint control and wafer-to-wafer thickness uniformity (WTWU) can be improved.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

One optical monitoring technique is to measure spectra of light reflected off of a substrate being polished and track a characteristic of a spectral feature, e.g., track the position of a peak in the measured spectra. Modifications to the polishing process or triggering of the polishing endpoint can be performed based on the value of the characteristic crossing a pre-determined boundary and/or by the characteristic changing by a predetermined amount (e.g., based on crossing a boundary calculated by adding a predetermined amount to the initial value of the characteristic).

However, for some layer structures on a substrate, features may move too much, e.g., the wavelength position of a peak can move completely across the wavelength band being monitored by the spectrographic system before polishing is completed. A technique to address this issue is to serially "stitch" together tracking of multiple features. For example, once the wavelength of an initially tracked peak crosses a boundary, a new peak is selected and the wavelength of the new peak is tracked.

Spectral features can include spectral peaks, spectral inflection points, or spectral zero-crossings. In this context, "peak" refers generally to a local extreme, e.g., a maxima (peak) or a minima (valley). The typical characteristic tracked will be the position of the spectral feature, e.g., the wavelength, frequency or wavenumber, depending on the measurement scale of the spectrum.

The position of a peak can be determined as the wavelength (or frequency or wavenumber) of the absolute maximum (or minimum for a valley) of the peak, or from a more complex algorithm such as a midpoint between two positions having a particular height on either side of the peak, or taking the derivative of the peak and identify the peak by the zero crossing of the derivative. If necessary, a function, e.g. Savitsky Golay, can be fit to the spectrum in order to further reduce noise, and the position of the spectral feature can be determined from the extrema in the fitted function.

The substrate can be as simple as a single dielectric layer disposed on a semiconductor layer, or have a significantly more complex layer stack. For example, the substrate can include a dielectric first layer and a metallic, semiconductive or dielectric second layer disposed under the first layer. However, using the position of a feature can be of particular use in front-end-of-line (FEOL) polishing processes where the index of refraction of the material is high (e.g., higher than an oxide), e.g., for poly or nitride polishing Chemical mechanical polishing can be used to planarize the substrate and remove the first layer until the second layer is exposed. Alternatively, it is sometimes desired to polish the first layer, until a target thickness remains over the second layer or a target amount of material of the first layer has been removed.

Figure 1:
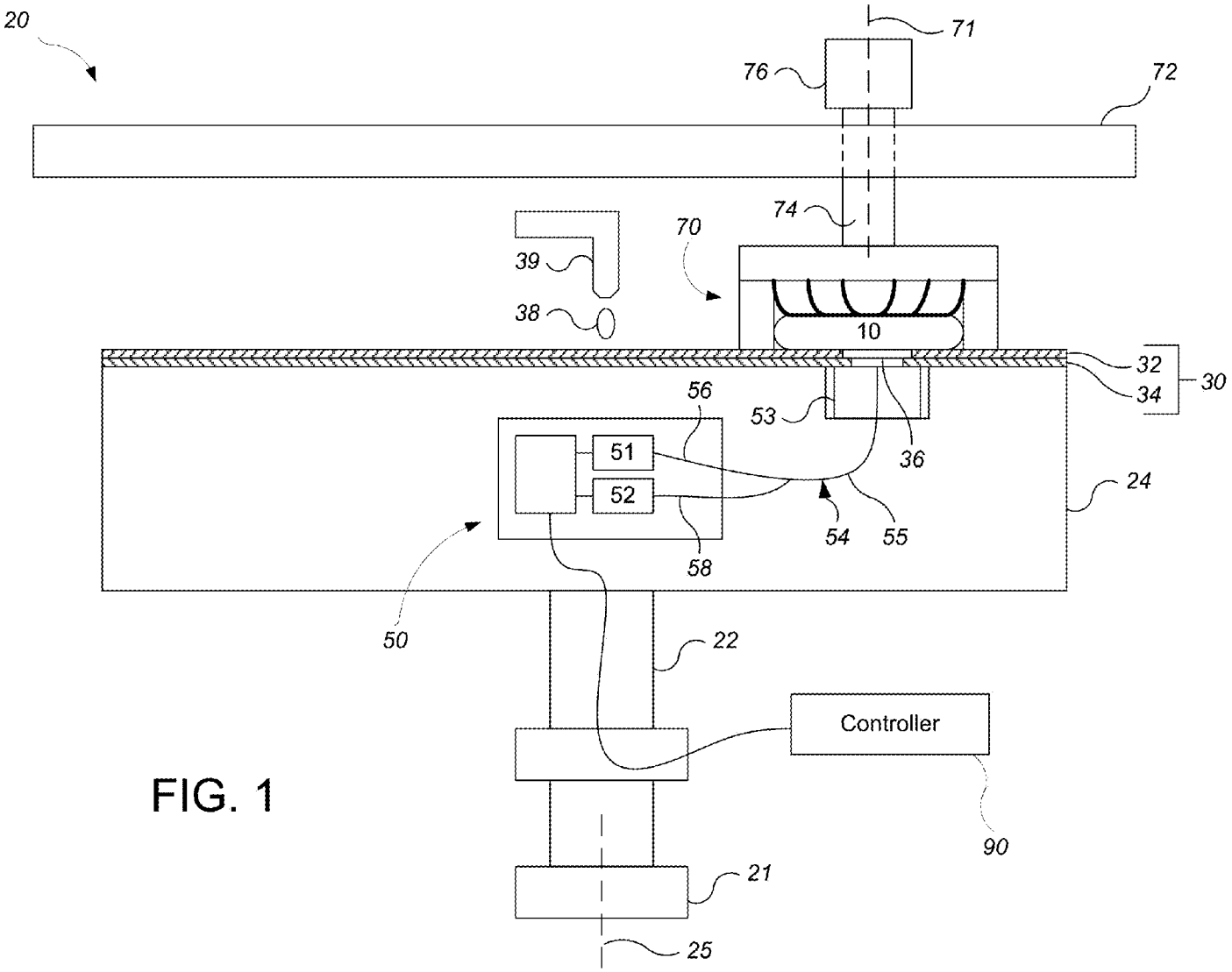
FIG. 1 shows a chemical mechanical polishing apparatus.

FIG. 1 shows a polishing apparatus 20 operable to polish a substrate 10. The polishing apparatus 20 includes a rotatable disk-shaped platen 24, on which a polishing pad 30 is situated. The platen is operable to rotate about axis 25. For example, a motor 21 can turn a drive shaft 22 to rotate the platen 24. The polishing pad 30 can be detachably secured to the platen 24, for example, by a layer of adhesive. When worn, the polishing pad 30 can be detached and replaced. The polishing pad 30 can be a two-layer polishing pad with an outer polishing layer 32 and a softer backing layer 34.

Optical access 36 through the polishing pad is provided by including an aperture (i.e., a hole that runs through the pad) or a solid window. The solid window can be secured to the polishing pad, although in some implementations the solid window can be supported on the platen 24 and project into an aperture in the polishing pad. The polishing pad 30 is usually placed on the platen 24 so that the aperture or window overlies an optical head 53 situated in a recess 26 of the platen 24. The optical head 53 consequently has optical access through the aperture or window to a substrate being polished.

The polishing apparatus 20 includes a combined slurry/rinse arm 39. During polishing, the arm 39 is operable to dispense a polishing liquid 38, e.g., slurry with abrasive particles. Alternatively, the polishing apparatus can include a port in the platen operable to dispense the polishing liquid onto polishing pad 30.

The polishing apparatus 20 includes a carrier head 70 operable to hold the substrate 10 against the polishing pad 30. The carrier head 70 is suspended from a support structure 72, for example, a carousel or track, and is connected by a carrier drive shaft 74 to a carrier head rotation motor 76 so that the carrier head can rotate about an axis 71. In addition, the carrier head 70 can oscillate laterally across the polishing pad, e.g., by moving in a radial slot in the carousel, by rotation of the carousel, or movement back and forth along the track. In operation, the platen 24 is rotated about its central axis 25, and the carrier head is rotated about its central axis 71 and translated laterally across the top surface of the polishing pad.

The polishing apparatus also includes a spectrographic optical monitoring system, which can be used to determine a polishing endpoint as discussed below. The optical monitoring system includes a light source 51 and a light detector 52. Light passes from the light source 51, through the optical access 36 in the polishing pad 30, impinges and is reflected from the substrate 10 back through the optical access 36, and travels to the light detector 52.

A bifurcated optical cable 54 can be used to transmit the light from the light source 51 to the optical access 36 and back from the optical access 36 to the light detector 52. The bifurcated optical cable 54 can include a "trunk" 55 and two "branches" 56 and 58.

As mentioned above, the platen 24 includes the recess 26, in which the optical head 53 is situated. The optical head 53 holds one end of the trunk 55 of the bifurcated fiber cable 54, which is configured to convey light to and from a substrate surface being polished. The optical head 53 can include one or more lenses or a window overlying the end of the bifurcated fiber cable 54. Alternatively, the optical head 53 can merely hold the end of the trunk 55 adjacent to the solid window in the polishing pad.

The platen includes a removable in-situ monitoring module 50. The in-situ monitoring module 50 can include one or more of the following: the light source 51, the light detector 52, and circuitry for sending and receiving signals to and from the light source 51 and light detector 52. For example, the output of the detector 52 can be a digital electronic signal that passes through a rotary coupler, e.g., a slip ring, in the drive shaft 22 to the controller for the optical monitoring system. Similarly, the light source can be turned on or off in response to control commands in digital electronic signals that pass from the controller 90 through the rotary coupler to the module 50.

The in-situ monitoring module 50 can also hold the respective ends of the branch portions 56 and 58 of the bifurcated optical fiber 54. The light source is operable to transmit light, which is conveyed through the branch 56 and out the end of the trunk 55 located in the optical head 53, and which impinges on a substrate being polished. Light reflected from the substrate is received at the end of the trunk 55 located in the optical head 53 and conveyed through the branch 58 to the light detector 52.

The light source 51 is operable to emit white light. In one implementation, the white light emitted includes light having wavelengths of 200-800 nanometers. A suitable light source is a xenon lamp or a xenon-mercury lamp.

The light detector 52 can be a spectrometer. A spectrometer is basically an optical instrument for measuring properties of light, for example, intensity, over a portion of the electromagnetic spectrum. A suitable spectrometer is a grating spectrometer. Typical output for a spectrometer is the intensity of the light as a function of wavelength. The spectrometer 52 typically has an operating wavelength band, e.g., 200-800 nanometers, or 250-1100 nanometers.

The light source 51 and light detector 52 are connected to a computing device 90 operable to control their operation and to receive their signals. The computing device can include a microprocessor situated near the polishing apparatus, e.g., a personal computer.

The spectra obtained as polishing progresses, e.g., from successive sweeps of the sensor in the platen across the substrate, provide a sequence of measured spectra. In some implementations, during each sweep across the substrate, spectra can be measured at a multiple different locations on the substrate 10. In some implementations, for each sweep, two or more of the spectra from the sweep can be combined, to provide a measured spectrum for the sweep. In some implementations, for each sweep, one spectrum can be selected from multiple spectra from the sweep, to provide a measured spectrum for the sweep.

Figure 2:
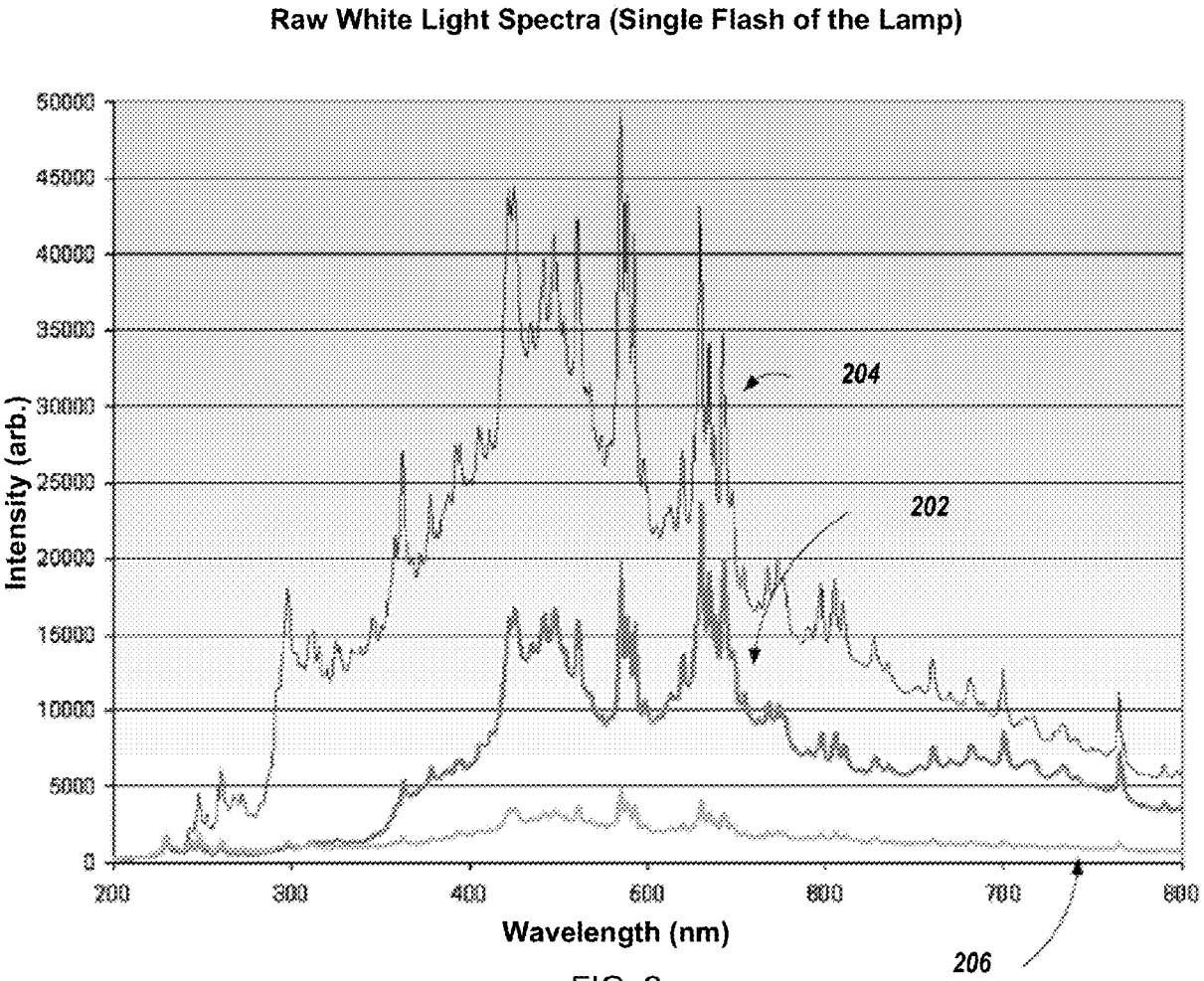
FIG. 2 shows a spectrum obtained from in-situ measurements.

With respect to receiving signals, the computing device can receive, for example, a signal that carries information describing a spectrum of the light received by the light detector 52. FIG. 2 shows examples of a spectrum measured from light that is emitted from a single flash of the light source and that is reflected from the substrate. Spectrum 202 is measured from light reflected from a product substrate. Spectrum 204 is measured from light reflected from a base silicon substrate (which is a wafer that has only a silicon layer). Spectrum 206 is from light received by the optical head 53 when there is no substrate situated over the optical head 53. Under this condition, referred to in the present specification as a "dark" condition, the received light is typically ambient light.

The optical monitoring system can pass the measured spectrum through a high-pass filter in order to reduce the overall slope of the spectrum. During processing of multiple substrates in a batch, for example, large spectra differences can exist among wafers. A high-pass filter can be used to normalize the spectra in order to reduce spectra variations across substrates in the same batch. An exemplary high-pass filter can have a cutoff of 0.005 Hz and a filter order of 4. The high-pass filter is not only used to help filter out sensitivity to underlying variation, but also to "flatten" out the legitimate signal to make feature tracking easier.

Measured spectra can also be normalized to remove or reduce the influence of undesired light reflections. Light reflections contributed by media other than the film or films of interest include light reflections from the polishing pad window and from the underlying layer of the substrate. Contributions from the window can be estimated by measuring the spectrum of light received by the in-situ monitoring system under a dark condition (i.e., when no substrates are placed over the in-situ monitoring system). Contributions from the underlying can be estimated by measuring the spectrum of light reflecting of a bare silicon substrate. The contributions are usually obtained prior to commencement of the polishing step. A measured raw spectrum can be normalized as follows:

$$\text{normalized spectrum}=(A-\text{Dark})/(X-\text{Dark})$$

where A is the raw spectrum, Dark is the spectrum obtained under the dark condition, and X is the spectrum of the underlying layer, e.g., a metal layer or the bare silicon substrate.

The computing device can process the above-described signal, or a portion thereof, to determine an endpoint of a polishing step. Without being limited to any particular theory, the spectrum of light reflected from the substrate 10 evolves as polishing progresses.

FIGS. 3A-3E provides an example of the evolution of the spectrum as polishing progresses on a film of interest. The different lines of spectrum represent different times in the polishing. As can be seen, the measured spectra change as the thickness of the film changes, and particular spectra are exhibited by particular thicknesses of the film.

Figure 3A:
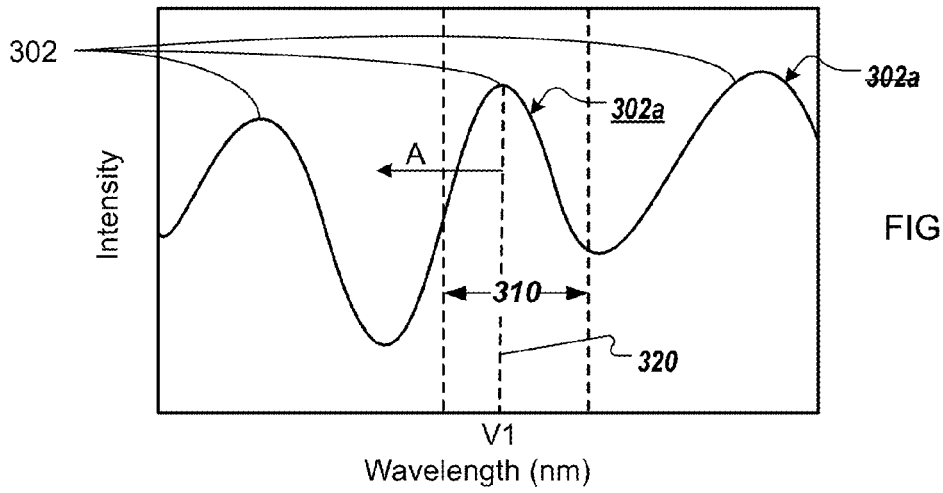
FIGS. 3A-3E illustrate the evolution of spectra obtained from in-situ measurements as polishing progresses.
Figure 3B:
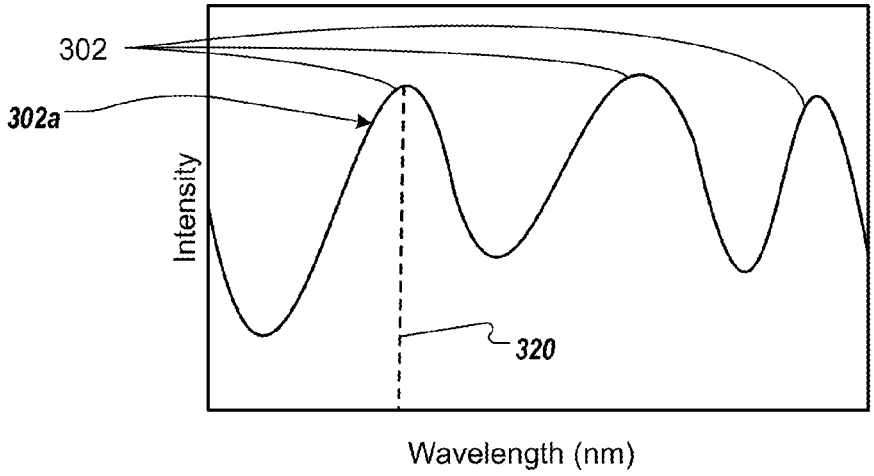
Figure 3C:
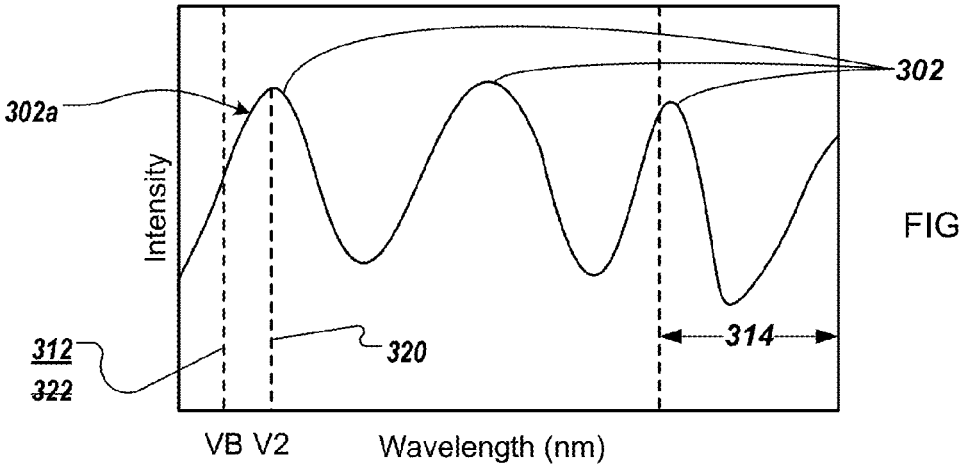

As illustrated, the measured spectra typically include one or more peaks 302 (local maxima or minima). As polishing progresses, the wavelength at which a particular peak is located typically changes, e.g., increases or decreases as polishing progresses. The direction of motion of the peak can be constant over the polishing process, e.g., the position of the peak changes monotonically over the polishing process. For example, as shown by FIGS. 3A-3C, a peak 302*a* moves from wavelength V1 to wavelength V2. This motion also applies to other spectral characteristics, e.g., inflection points or zero-crossings.

In addition, as the polishing of a film progresses, the height and/or width of the peak typically changes, and the peak tends to grow wider as material is removed. For example, this effect can occur in the case of a blanket dielectric or poly film.

Either the absolute position or relative change in position of the wavelength of a peak or other spectral characteristic could be used to determine modifications for the polishing process or to detect the polishing endpoint.

Figure 3D:
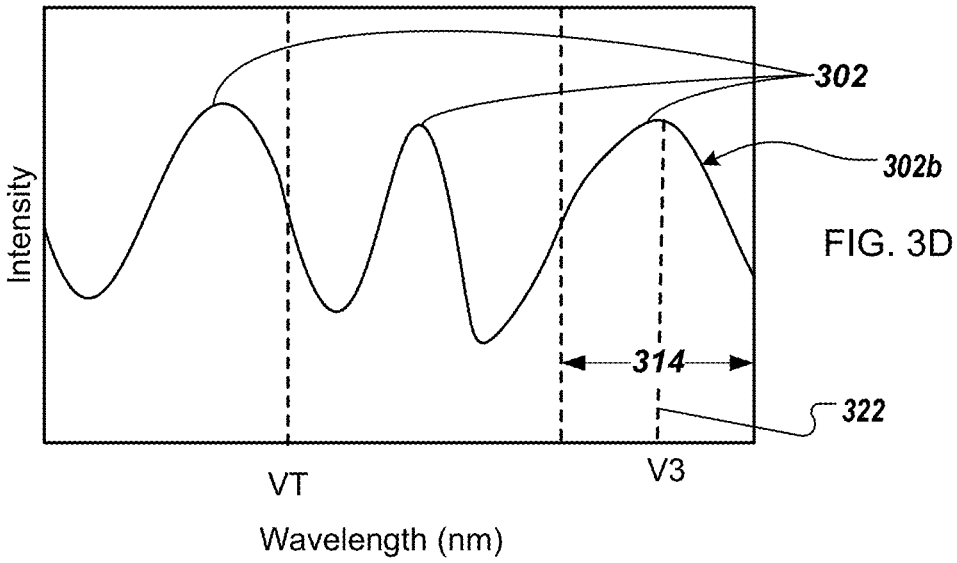

However, as noted above, not all peaks persist throughout the entire polishing process. First, the wavelength position of a peak can move completely across the wavelength band being monitored by the spectrographic system before polishing is completed, e.g., as shown by FIGS. 3C and 3D, the peak 302*a* has moved out of the wavelength range being monitored by the spectrographic system. Second, it is possible for the height of the peak to decrease until the peak is no longer present or cannot be detected over noise in the spectrum.

As described in the technique below, the optical monitoring system switches from tracking of one spectral feature to a different spectral feature. For example, once the wavelength of an initially tracked peak crosses a boundary, a new peak is selected and the wavelength of the new peak is tracked.

Figure 4:
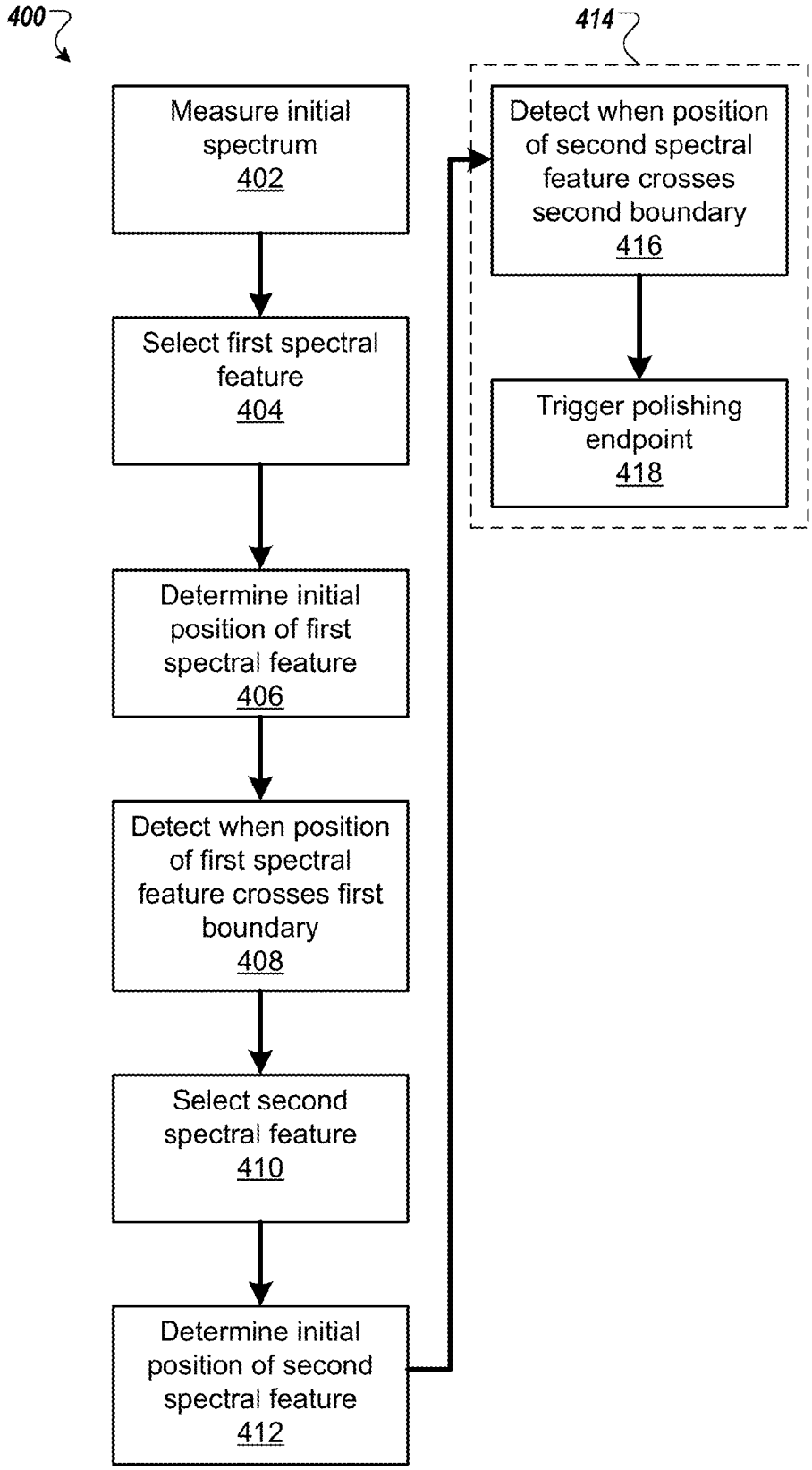
FIG. 4 is a flow chart of a method of optical monitoring.

Referring to FIGS. 3A and 4, an initial spectral feature 302*a* is selected for tracking. For example, at the beginning of the polishing process or at a predetermined time after initiation of the polishing process, an initial spectrum is measured (step 402). A first spectral feature is selected for tracking (step 404). For example, a predetermined first wavelength range 310 can be searched for a spectral feature, e.g., a peak, e.g., a local maximum. The first spectral feature has a position 320 that will change (shown by arrow A) as polishing progresses. The initial position, e.g., given by wavelength V1, of the spectra feature can be determined (step 406). The limits of the first wavelength range can be determined based on experiment.

Referring to FIG. 3B, as polishing progresses, the position 320 of the first spectral feature will change, e.g., shift to a lower wavelength.

Referring to FIGS. 3C and 4, the optical monitoring system detects when the position 320 of the first spectral feature 302*a* crosses a boundary 312 (step 408). For example, the system can detect when the wavelength of the first spectral feature 302*a* crosses a threshold wavelength VB. If the first spectral feature will move completely across the wavelength band being monitored by the spectrographic system, then the boundary 312 can be at or near the edge of wavelength band. For example, if the wavelength of the spectral feature 302*a* is decreasing as polishing progresses, then the boundary 312 can be at or near (e.g., in the lower quartile of) the lowest wavelength of the wavelength band monitored by the spectrographic system. Similarly, if the wavelength of the spectral feature 302*a* is increasing as polishing progresses, then the boundary 312 can be at or near (e.g., in the upper quartile of) the highest wavelength of the wavelength band monitored by the spectrographic system. If the spectral feature disappears in the course of polishing due to the height of the peak decreasing, then the boundary 312 should be placed somewhat before (depending on the direction of travel of the peak) where the spectra feature will disappear, in a spot where the feature can still be reliably detected. The approach to use and the exact values for the boundary can be determined based on experiment.

Referring to FIGS. 3D and 4, when the system detects that the position of the first spectral feature 302*a* has crossed the boundary 312, the system selects a second spectral feature 302*b* for tracking (step 410). For example, the second spectral feature 302*b* can be selected out of the spectrum measured at the time the first spectra feature 302*a* crosses the boundary 312. For example, a predetermined second wavelength range 314 can be searched for a spectral feature, e.g., a peak, e.g., a local maximum. The second spectral feature has a position 322 that will change as polishing progresses. The initial position, e.g., given by wavelength V3, of the second spectral feature can be determined (step 412).

The predetermined second wavelength range 314 will be "upstream" of the boundary 312. For example, if the wavelength of the spectral features 302*a*, 302*b* decrease as polishing progresses, then the second wavelength range will be at a larger wavelength than the boundary 312. Similarly, if the wavelength of the spectral features 302*a*, 302*b* increase as polishing progresses, then the second wavelength range will be at a shorter wavelength than the boundary 312. In some implementations, the second wavelength range extends to an edge of the wavelength range monitored by the spectrographic system, but this is not required. The limits of the second wavelength range boundary can be determined based on experiment.

Figure 3E:
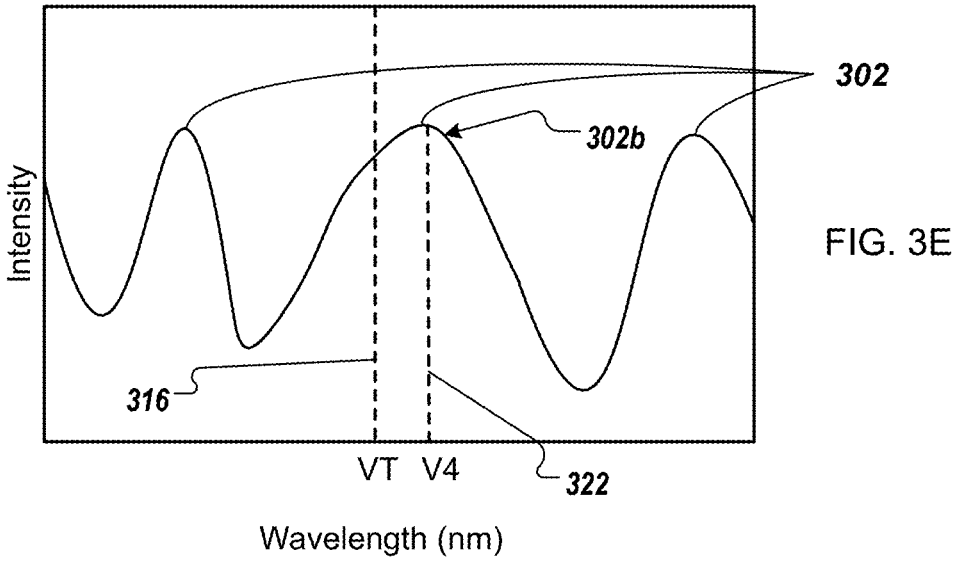

Referring to FIGS. 3E and 4, the optical monitoring system monitors the position 322 of the second spectral feature 302*b*, and uses this data to control the polishing operation (step 414.

For example, to detect a polishing endpoint, the system can detect when the position 322 of the second spectral feature 302*b* crosses a second boundary 316 (step 416), and use this to trigger the polishing endpoint (step 418). For example, the system can detect when the wavelength of the second spectral feature 302*a* crosses a threshold wavelength VT. For example, if the wavelength of the second spectral feature 302*a* is decreasing as polishing progresses, then the wavelength VT will be lower than the initial wavelength V3. Similarly, if the wavelength of the second spectral feature 302*b* is increasing as polishing progresses, then the threshold wavelength VT will be higher than the initial wavelength V3.

The second boundary can be a pre-determined boundary, e.g., some particular wavelength, or the second boundary can be calculated by adding or subtracting (depending on the direction of travel of the second spectral feature 302*b*) a predetermined amount to the initial position determined in step 412. For example a predetermined change in wavelength, ΔV can be added to or subtracted from the initial wavelength V3 to calculate VT.

The wavelength ranges 310, 314 can each have a width of between about 50 and about 200 nanometers. In some implementations, the wavelength ranges 310, 314 are predetermined, e.g., specified by an operator, e.g., by receiving user input selecting the wavelength range, or specified as a process parameter for a batch of substrates, by retrieving the wavelength range from a memory associating the wavelength range with the batch of substrates. In some implementations, the wavelength ranges 310, 314 are based on historical data, e.g., the average or maximum distance between consecutive spectrum measurements.

Figure 5:
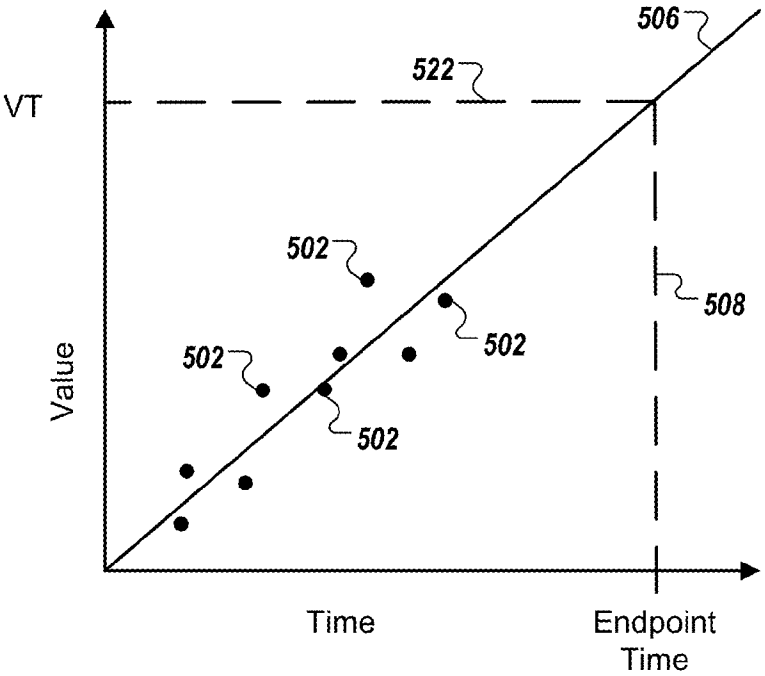
FIG. 5 shows an example graph of polishing progress, measured in characteristic value versus time.

Turning now to the polishing of a device substrate, FIG. 5A is an example graph of values 502 generated by the optical monitoring system during polishing of a device substrate 10 during monitoring of the position 322 of the second spectral feature 302*b*.

As the substrate 10 is polished, the light detector 52 measures spectra of light reflected from the substrate 10. The endpoint determination logic in the controller 90 uses the spectra of light to determine a sequence of values for the feature characteristic. The values 502 change as material is removed from the surface of the substrate 10.

As noted above, each value 502 can be an absolute position value of the spectral feature, or a change in position from an initial value. In addition, in some implementations, either the value or the change in value can be converted, e.g., using a look-up table, a thickness value, which provide the values 502.

In some implementations, endpoint can be called when the current value of the second spectral feature reaches a target value 522. If the values 502 are the values of the position 322 of the second spectral feature, then the target value 522 is the second boundary 316.

In some implementations, a function 506 is fit to the values 502. The function 506 can be used to determine the polishing endpoint time. In some implementations, the function is a linear function of time. The linear function can be fit, e.g., using a robust line fit. In some implementations, the time at which the function 506 equals the target value 522, provides the endpoint time 508.

Figure 6:
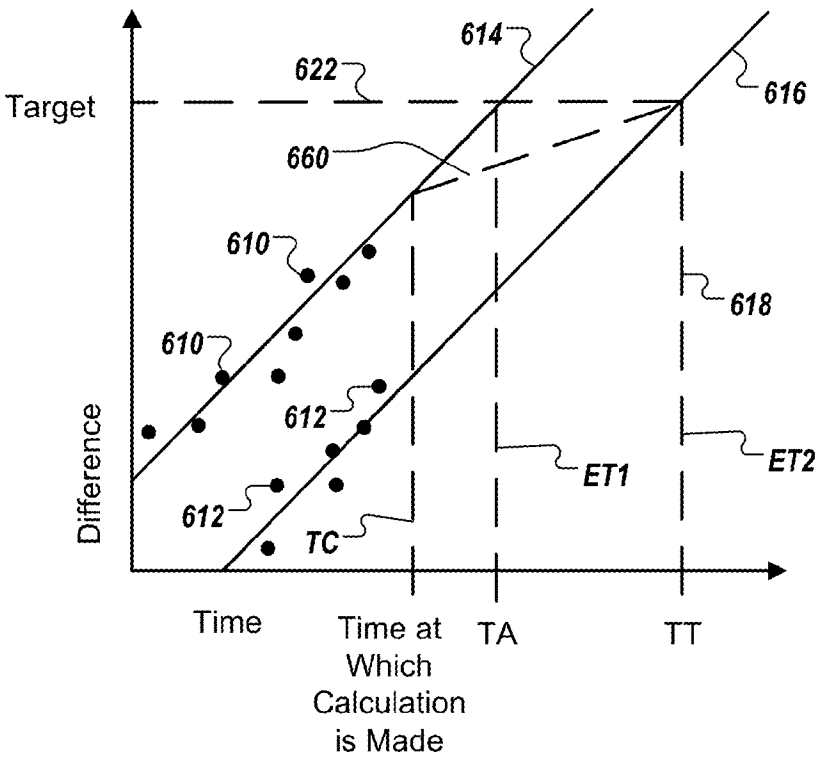
FIG. 6 shows an example graph of polishing progress, measured in characteristic value versus time, in which characteristics of two different features are measured in order to adjust the polishing rate of a substrate.

FIG. 6 is an example graph of characteristic values for two different zones on the substrate 10. For example, the optical monitoring system 50 can track a first zone located toward an edge portion of the substrate 10 and a second zone located toward a center of the substrate 10. As the substrate 10 is being polished, the light detector 52 can measure a sequence of spectra of reflected light from the two zones of the substrate 10. For each zone, the optical monitoring system can switch from monitoring a first spectral feature to monitoring a second spectral feature as discussed above. A sequence of first values 610 can be measured for the characteristic of the second spectral feature based on spectra measured from the first zone of the substrate 10. A sequence of second values 612 can similarly be measured for the characteristic of the second spectral feature based on spectra measured from the second zone of the substrate 10.

A first function 614, e.g., a first line, can be fit to the sequence of first values 610, and a second function 616, e.g., a second line, can be fit to the sequence of second values 612. The first function 614 and the second function 616 can be used to determine to an adjustment to the polishing rate of the substrate 10.

During polishing, an estimated endpoint calculation based on a target value 622 is made at time TC with the first function for the first portion of the substrate 10 and with the second function for the second portion of the substrate. If the estimated endpoint times ET1 and ET2 for the first zone of the substrate and the zone portion of the substrate differ (or if the values of the first function and second function at an estimated endpoint time 618 differ), the polishing rate of at least one of the zones can be adjusted so that the first zone and second zone have closer to the same endpoint time than without such an adjustment. For example, if the first zone will reach the target value 622 before the second zone, the polishing rate of the first zone can be decreased (shown by line 660) such that the first zone will reach the target value 622 at substantially the same time as the second zone. In some implementations, the polishing rates of both the first portion and the second portion of the substrate are adjusted so that endpoint is reached at both portions simultaneously. Alternatively, the polishing rate of only the first portion or the second portion can be adjusted.

The polishing rates can be adjusted by, for example, increasing or decreasing the pressure in a corresponding region of the carrier head 70. The change in polishing rate can be assumed to be directly proportional to the change in pressure, e.g., a simple Prestonian model. For example, when the first zone of the substrate 10 is projected to reach the target thickness at a time TA, and the system has established a target time TT, the carrier head pressure in the corresponding region before time TC can be multiplied by TT/TA to provide the carrier head pressure after time TC. At a subsequent time during the polishing process, the rates can again be adjusted, if appropriate.

There are many techniques to remove noise from the sequence of values. Although fitting a line to the sequence is discussed above, a non-linear function could be fit to the sequence, or a low pass median filter could be used to smooth the sequence (in which case the filtered value could be directly compared to the target value to determine the endpoint).

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in an information carrier, e.g., in a non-transitory machine-readable storage medium or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, subprograms, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

The above described polishing apparatus and methods can be applied in a variety of polishing systems. Either the polishing pad, or the carrier head, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A method of controlling polishing, comprising:

polishing a substrate;

measuring with an in-situ spectrographic optical monitoring system a first sequence of spectra of light reflected from the substrate while the substrate is being polished;

selecting a first spectral feature in the first sequence of spectra, the first spectral feature having an evolving first location through the first sequence of spectra;

for each measured spectrum from the first sequence of spectra, determining a first position value for the first spectral feature to generate a sequence of first position values;

determining that the first location of the first spectral feature has crossed a first boundary based on the sequence of first position values;

measuring a second sequence of spectra of light reflected from the substrate while the substrate is being polished after the first spectral feature has crossed the first boundary;

upon determining that the first location of the first spectral feature has crossed the first boundary, selecting a second spectral feature, the second spectral feature having an evolving second location through the second sequence of spectra;

for each measured spectrum from the second sequence of spectra, determining a second position value for the second spectral feature to generate a sequence of second position values; and at least one of triggering a polishing endpoint or adjusting a polishing parameter based on the second sequence of position values.

2. The method of claim 1, comprising triggering the polishing endpoint upon determining that the second location of the second spectral feature has crossed a second boundary.

3. The method of claim 2, comprising fitting a function to the sequence of second position values, and wherein determining that the second location of the second spectral feature has crossed the second boundary comprises determining that the function has crossed a threshold.

4. The method of claim 1, comprising determining an initial position value of the first spectral feature and determining a current position value of the first spectral feature, and wherein the first position value comprises a difference between the initial position value and the current position value.

5. The method of claim 1, wherein selecting the second spectral feature comprises searching a predetermined second wavelength range for the second spectral feature.

6. The method of claim 5, wherein searching the predetermined second wavelength range comprises finding a local maxima or a local minima in the predetermined second wavelength range.

7. The method of claim 1, wherein a wavelength of the first spectral feature changes monotonically in a first direction over time, and the predetermined second wavelength range is positioned on a side of the first boundary opposite the first direction.

8. The method of claim 1, wherein the first boundary is near an edge of an operating range of the spectrographic optical monitoring system.

9. The method of claim 1, wherein the second boundary is near an edge of an operating range of the spectrographic optical monitoring system.

10. A computer program product encoded on a non-transitory computer storage medium, operable to cause a processor to perform operations to control a polishing operation, the operations comprising:

receiving from an in-situ spectrographic optical monitoring system measurements of a first sequence of spectra of light reflected from the substrate while the substrate is being polished;

selecting a first spectral feature in the first sequence of spectra, the first spectral feature having an evolving first location through the first sequence of spectra;

for each measured spectrum from the first sequence of spectra, determining a first position value for the first spectral feature to generate a sequence of first position values;

determining that the first location of the first spectral feature has crossed a first boundary based on the sequence of first position values;

receiving from the in-situ spectrographic optical monitoring system measurements of a second sequence of spectra of light reflected from the substrate while the substrate is being polished after the first spectral feature has crossed the first boundary;

upon determining that the second location of the first spectral feature has crossed the first boundary, selecting a second spectral feature, the second spectral feature having an evolving second location through the second sequence of spectra;

for each measured spectrum from the second sequence of spectra, determining a second position value for the second spectral feature to generate a sequence of second position values; and at least one of triggering a polishing endpoint or adjusting a polishing parameter based on the second sequence of position values.

11. A polishing system, comprising:

a platen to support a polishing pad;

a carrier head to hold a substrate in contact with the polishing pad;

an in-situ spectrographic optical monitoring system configured to measure spectra of light reflected from the substrate while the substrate is being polished; and a controller configured to receive from the in-situ spectrographic optical monitoring system measurements of a first sequence of spectra of light reflected from the substrate while the substrate is being polished;

select a first spectral feature in the first sequence of spectra, the first spectral feature having an evolving first location through the first sequence of spectra;

for each measured spectrum from the first sequence of spectra, determine a first position value for the first spectral feature to generate a sequence of first position values;

determine that the first location of the first spectral feature has crossed a first boundary based on the sequence of first position values;

receive from the in-situ spectrographic optical monitoring system measurements of a second sequence of spectra of light reflected from the substrate while the substrate is being polished after the first spectral feature has crossed the first boundary;

upon determining that the first location of the first spectral feature has crossed the first boundary, select a second spectral feature, the second spectral feature having an evolving second location through the second sequence of spectra;

for each measured spectrum from the second sequence of spectra, determine a second position value for the second spectral feature to generate a sequence of second position values; and at least one of trigger a polishing endpoint or adjust a polishing parameter based on the second sequence of position values.

12. The method of claim 1, comprising determining an initial position value of the second spectral feature at a time that the first spectral feature crosses the first boundary, and comprising determining a current position value of the second spectral feature, and wherein the second position value comprises a difference between the initial position value and the current position value.

13. The computer program product of claim 10, wherein the operations comprise triggering the polishing endpoint upon determining that the second location of the second spectral feature has crossed a second boundary.

14. The computer program product of claim 13, wherein the operations comprise fitting a function to the sequence of second position values, and wherein determining that the second location of the second spectral feature has crossed the second boundary comprises determining that the function has crossed a threshold.

15. The computer program product of claim 10, wherein the first spectral feature and the second spectral feature each comprise a peak, an inflection point or a zero-crossing.

16. The computer program product of claim 15, wherein the first spectral feature and second spectral feature each comprise a local maxima or a local minima.

17. The computer program product of claim 10, wherein the operations comprise determining an initial position value of the first spectral feature and determining a current position value of the first spectral feature, and wherein the first position value comprises a difference between the initial position value and the current position value.

18. The computer program product of claim 10, wherein the operations comprise determining an initial position value of the second spectral feature at a time that the first spectral feature crosses the first boundary, and the operations further comprise determining a current position value of the second spectral feature, and wherein the second position value comprises a difference between the initial position value and the current position value.

19. The computer program product of claim 10, wherein selecting the second spectral feature comprises searching a predetermined second wavelength range for the second spectral feature.

20. The computer program product of claim 19, wherein searching the predetermined second wavelength range comprises finding a local maxima or a local minima in the predetermined second wavelength range.

* * * * *